US005119904A

United States Patent [19]

Dierolf

[11] Patent Number: 5,119,904

[45] Date of Patent: Jun. 9, 1992

[54] SUPPORT FOR WALKING ON TILE ROOFS

[76] Inventor: Dave Dierolf, 3533 Fairmont Ave., San Diego, Calif. 92105

[21] Appl. No.: 754,072

[22] Filed: Sep. 3, 1991

[51] Int. Cl.[5] ..... A47C 7/50

[52] U.S. Cl. ..... 182/230; 182/45; 2/24

[58] Field of Search ..... 182/230, 45, 194; 248/237; 2/24

[56] References Cited

U.S. PATENT DOCUMENTS

| | | | |
|---|---|---|---|
| 2,708,543 | 5/1955 | Matich | 182/45 |
| 3,258,779 | 7/1966 | Turner | 182/230 |
| 3,499,502 | 3/1970 | Rosander | 182/230 |
| 3,544,054 | 12/1970 | Ward | 182/230 |
| 4,230,202 | 10/1980 | Kudra | 182/45 |

*Primary Examiner*—Reinaldo P. Machado

[57] ABSTRACT

Means and method are provided for walking on residential and commercial tile roofs with minimal breakage of the tile, there being a support provided having a planar backboard of plywood or the like with a pair of spaced, soft resilient parallel cushions on the front surface which are laid down into the troughs of the tile roof to distribute weight, and to distribute the weight particularly into the troughs of the roof, which are supported underneath by the sub-roof. The supports are distributed in a pathway over the roof to get the workman to the point on the roof that he needs to access, without stepping directly on the tiles.

11 Claims, 1 Drawing Sheet

Fig. 1
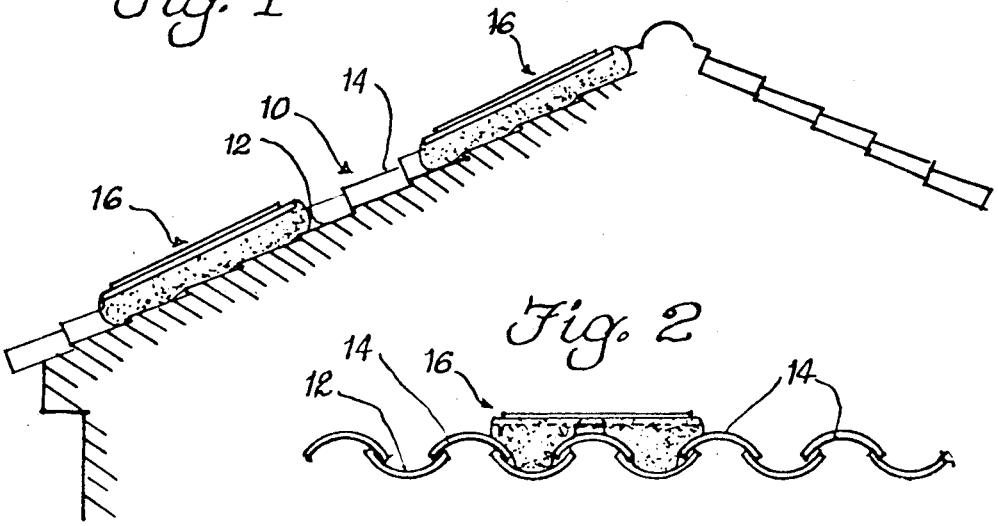
Fig. 2
Fig. 3
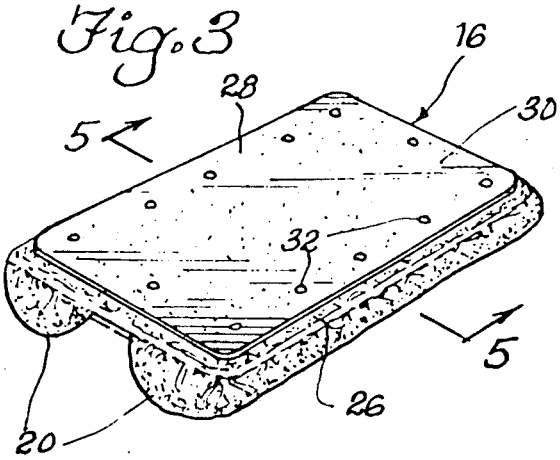
Fig. 4
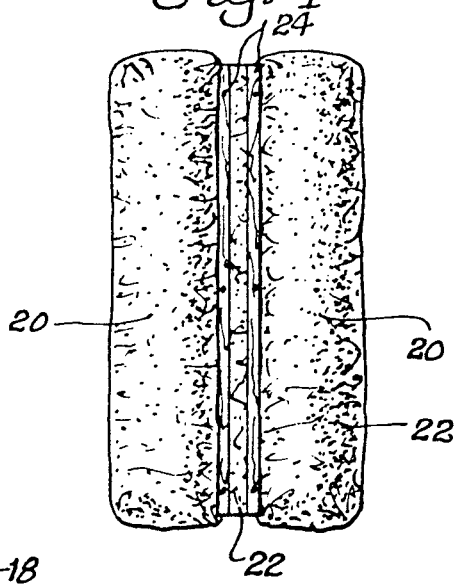
Fig. 5
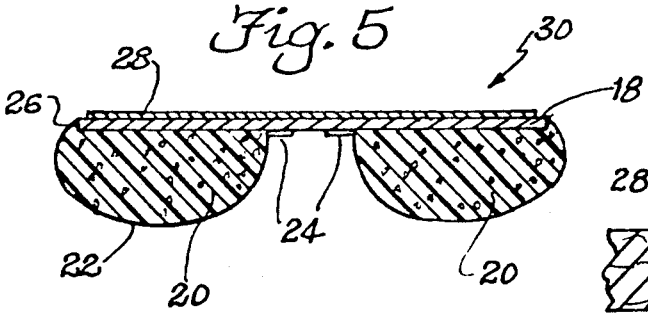
Fig. 6
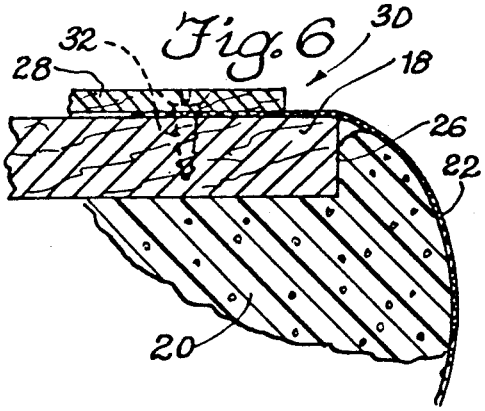

SUPPORT FOR WALKING ON TILE ROOFS

BACKGROUND OF THE INVENTION

Tile roofs are charming to look at, are quite waterproof and weatherproof and add value to a home or business, but they are not meant to be walked on. Walking on a tile roof, no matter how careful the person is, will result in the breakage of tiles.

For example, when putting a tent over a house in order to do termite extermination work, one of the workers must get up on the roof and make his way along the seams between the 43'×60', tarps to join them together, and he also must get to the top of the roof. Traditionally, extermination companies make no guarantees as to the safety of the roof and charge the owner a certain amount per tile to repair broken tiles. Repairing broken tiles on a modest residence can easily cost $600 to $700 for a termite tenting job. This is the way tile roofs are done in the termite extermination business. No technique has been developed or apparatus created which enables workers to move around on the rooftop without destroying tiles.

Clearly, there is a need for some kind of system that would enable workers to traverse across a tile roof without destroying tiles in the process.

SUMMARY OF THE INVENTION

The instant invention fulfills the above stated need and comprises a support which the roof worker can lay on the roof, and subsequently be able to walk on the support without damaging underlying tiles. Because the worker needs to traverse the roof and also get to the peak of the roof, it requires more than one support to do the job. He must position the first support, take a second support, walk across the first support and put the second support in place within stepping distance of the first support. He does the same with a second, third, and fourth, etc., until his pathways across the roof are all set. Alternatively, he can use two supports and leapfrog them. He then takes up the roof tenting, attaching the tent tarps together along their seams which overlie the path he has made with the supports. After fumigating the building, the supports are removed in the reverse order in which they were placed.

Each support comprises a flat, rigid panel having a pair of parallel, spaced, soft and resilient cushions mounted to one side. These cushions, which are semi-cylindrical in the preferred embodiment, are spaced such that they sink down into the troughs of the tile roof on each side of a peak. The worker's weight is thus distributed among various tiles, and particularly on the trough tiles which are supported underneath on the roof structure, rather than on the peak tiles which are relatively unsupported.

BRIEF DESCRIPTION OF THE DRAWINGS

FIG. 1 is a diagrammatic side elevation view of a tile roof illustrating two supports in place;

FIG. 2 is an end elevation view of a typical alternate overlapping tile roof structure, illustrating the support in place;

FIG. 3 is a perspective view of the support of the invention;

FIG. 4 is a front face elevation view of the support taken on the side of the rigid back panel which mounts the semi-cylindrical cushions;

FIG. 5 is a section taken along line 5—5 of FIG. 3; and,

FIG. 6 is a detailed partial section taken transversely of the support illustrating the sandwich bonding between the non-skid sheet and the plywood sheet.

DETAILED DESCRIPTION OF THE PREFERRED EMBODIMENT

As shown in FIGS. 1 and 2, a tile roof 10 of the type envisioned in this disclosure is made of convex tile segments which are alternated so that one row of the tiles creates troughs 12 and the interstitial rows define peaks 14. The same kind of tile can be used for both the troughs and the peaks. This is a very durable roof from an ultraviolet light and weather perspective and is very effective in keeping out rain. However, because of the fact that most of the space under the surface of the tiles is a void rather than representing some kind of solid support, the tiles are extremely prone to breakage upon the application of a significant weight from above.

The support of the instant invention designed to solve the tile breakage problem is indicated at 16 in FIGS. 3 through 5. At the core of the support is a plywood sheet 18, which is on the order of 22 inches wide, and 4 to 6 feet long. This is wide enough to span two troughs, and long enough to provide an adequate length of pathway for the worker before he must step to the next support.

On the front, or bottom side of the support are a pair of spaced cushions 20. These cushions could be cylindrical, but in the preferred and illustrated embodiment they are semi-cylindrical, being formed from a single 10-inch foam cylinder which is cut in half to define both cushions. These cushions are then preferably glued to the underface of the plywood sheet 18, and are further retained on the plywood sheet by means of an impervious sheet of tough plastic 22, or another impervious, flexible material. Although theoretically this sheet need not be impervious, or no sheet at all need be used, because of the layers of dirt and soot on the average roof an impermeable sheet is a practical accommodation.

This sheet is fixed flush against the center line of the plywood sheet by means of firing strips 24, with the edges being wrapped over and around the edges 26 of the plywood. The edges are captured between the plywood sheet 18 and an overlying non-skid sheet 28, which in the preferred embodiment is pressboard, which is much less prone to slippage than is plywood. The pressboard non-skid sheet and the plywood sheet 18 together make the rigid backing panel 30 that provides the planar strength to support a worker. The non-skid sheet is bonded to the plywood sheet by means of wood screws 32 placed around its periphery, having the secondary effect of securely sandwiching the edges of the plastic sheet between the plywood and the non-skid sheet.

In use, the worker first places a first one of the supports adjacent the roof edge as shown in FIG. 1, close enough to the edge so he can step on it from a ladder. Then, with a second support in hand he climbs onto the first support and positions the second support farther along his intended path. He may then continue to put subsequent supports up, so that his entire path is in essence covered, or he may step onto the second support and move the first support to where the third support should be, and so forth, leap-frogging his way across the roof to his destination.

Either way, in this fashion he may traverse the entire roof without any limitation. The support has been used on a number of actual applications, and to date not a single tile has been broken. Using the support in the above-described operation may require on the order of fifteen minutes longer than it would take without the support, but the savings in tile damage is ordinarily hundreds of dollars. In fact, the operator is able to insure the job for a substantial extra sum, more than enough to pay for fifteen minutes extra time, and be virtually guaranteed that no tiles, or very few tiles, will be broken.

The support and its method of use are not limited to the trough-type tiles illustrated and described. Some roofs have flat tiles, which are also prone to breakage. The support works equally effectively on flat tile roofs. It will also work on aluminum roofs. In fact, any roof in which the roofing material is not firmly supported underneath and lacks the inter-support strength to support workers walking on it, can be traversed using this support. It is the essence of simplicity, being easy to manufacture and inexpensive in materials, and simple enough to use that even the most unskilled worker can be instructed in its use within a minute or two.

It is hereby claimed:

1. A support for enabling workmen to walk on a tile roof having alternative ridges and troughs without damaging the tiles comprising:

(a) a rigid backing panel; and, (b) two spaced parallel resilient cushions mounted on one side of said panel, the spacing of said cushions being on the order of the spacing between the tile troughs of the roof.

2. Structure according to claim 1 wherein said cushions are foam.

3. Structure according to claim 2 wherein said cushions are substantially semi-cylinders having flat sides mounted to said panel.

4. Structure according to claim 3 wherein said semi-cylinders are covered with a flexible impervious cover.

5. Structure according to claim 4 wherein said cover covers the side of said panel which mounts said cushions in its entirety.

6. Structure according to claim 5 wherein said panel includes a plywood sheet with said cover wrapped around same on the side thereof which mounts said cushions, and said sheet having edges wrapping around said plywood sheet and being fastened thereto on the side thereof remote from said cushions.

7. Structure according to claim 6 wherein said panel further includes a non-skid sheet fastened to the side of said plywood remote from said cushions, which non-skid sheet compresses said edges between itself and said plywood sheet.

8. Structure according to claim 7 wherein said non-skid sheet is pressboard screwed to said plywood sheet through the edges of said cover.

9. Structure according to claim 1 wherein said panel is on the order of 22 inches wide, four feet to six feet long, and said cushions are spaced on the order of 13 inches on center.

10. A method of traversing on foot at least a portion of a tile roof having alternative ridges and troughs without damaging tiles, comprising the following steps:

(a) placing a first support comprising a rigid panel having a pair of spaced resilient parallel cushions mounted flush against the underside thereof, on said tile within stepping distance of one edge of the roof, such that the cushions align substantially as well as possible with troughs of said roof;

(b) with a second support in hand, stepping onto the first support and placing said second support within stepping distance of said first support, on the roof in the substantially same manner as the first support;

(c) acquiring a third support and placing it on the roof within stepping distance of one of the first two supports in substantially the same manner as was placed the first and second supports;

(d) continuing to place subsequent supports on the roof in substantially the same manner as were placed the first three supports with said supports defining a walking pathway to the region of the roof which must be traversed to; and, (e) traversing said supports to get to said region.

11. A method of traversing on foot at least a portion of a tile roof having alternate ridges and troughs without damaging tiles, comprising the following steps:

(a) placing a first support comprising a rigid panel having a pair of spaced parallel resilient cushions mounted flush against the underside thereof, on said tile within stepping distance of one edge of the roof, such that the cushions align substantially as well as possible with troughs of said roof;

(b) with a second support in hand, stepping onto the first support and placing said second support within stepping distance of said first support, on the roof in the substantially same manner as the first support;

(c) while standing on said second support, picking up said first support and placing it between said second support and the destination on the roof, within stepping distance of said second support; and, (d) stepping from said second support on said first support, and picking up said second support and moving it closer to the destination, and continuing to move by leap-frogging the supports in this fashion so that any point in the roof may be accessed by continually moving one or the other of two supports as set forth in steps (a), (b), and (c).

* * * * *